US008695694B1

(12) United States Patent
Lajesic

(10) Patent No.: US 8,695,694 B1
(45) Date of Patent: Apr. 15, 2014

(54) BOREHOLE SELECTOR ASSEMBLY

(71) Applicant: Halliburton Energy Services, Inc., Houston, TX (US)

(72) Inventor: Borisa Lajesic, Addison, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/944,481

(22) Filed: Jul. 17, 2013

Related U.S. Application Data

(63) Continuation of application No. PCT/US2012/062569, filed on Oct. 30, 2012.

(51) Int. Cl.
*E21B 23/12* (2006.01)

(52) U.S. Cl.
USPC ..... 166/117.6; 166/117.5; 175/80

(58) Field of Classification Search
USPC ..... 166/117.5, 117.6; 175/80
See application file for complete search history.

(56) References Cited

U.S. PATENT DOCUMENTS 5,322,127 A 6/1994 Mcnair et al.
5,388,648 A 2/1995 Jordan, Jr.
5,526,880 A 6/1996 Jordan et al.
5,533,573 A * 7/1996 Jordan et al. ..... 166/313
5,732,773 A * 3/1998 Parks et al. ..... 166/117.5
6,089,320 A 7/2000 LaGrange
2005/0121190 A1 6/2005 Oberkircher et al.

OTHER PUBLICATIONS

International Patent Application No. PCT/US2012/062569, "International Search Report and Written Opinion", mailed Apr. 26, 2013 (10 Pages).

* cited by examiner

*Primary Examiner* — William P Neuder
*Assistant Examiner* — Richard Alker
(74) *Attorney, Agent, or Firm* — Kilpatrick Townsend & Stockton LLP

(57) ABSTRACT

A deflector assembly includes two deflectors that can cooperate for directing a bullnose assembly toward an intended bore in a multi-bore well based on a configuration of the bullnose assembly without requiring use of gravitational forces or requiring the assembly to be oriented in a certain manner. The deflectors can cooperate by being spaced by a certain amount that, depending on if the amount is less than or greater than a longitudinal length and diameter of a bullnose of the bullnose assembly, can allow the bullnose assembly to be diverted toward the intended bore.

19 Claims, 7 Drawing Sheets

BOREHOLE SELECTOR ASSEMBLY

CROSS-REFERENCE TO RELATED APPLICATIONS

This is a continuation of PCT/US2012/062569, filed Oct. 30, 2012, the entirety of which is incorporated herein by reference.

TECHNICAL FIELD OF THE INVENTION

The present invention relates generally to a selector assembly to be located in a wellbore and, more particularly (although not necessarily exclusively), to a multi-deflector assembly for guiding a bullnose assembly into a selected borehole within the wellbore.

BACKGROUND

Various devices can be installed in a well traversing a hydrocarbon-bearing subterranean formation. Some devices direct assemblies in the well towards a bore in the well. For example, the well may be a multi-bore well including a main bore and one or more lateral bores extending from the main bore. A deflector is a device that can be positioned in the well, for example at a junction, and configured to direct, toward the main bore or a lateral bore, an assembly that is run downhole.

Selecting the appropriate bore between the main bore and the lateral bore to which to direct the assembly can be difficult. Often, accurate selection requires that both the deflector and the assembly be orientated within the well correctly and requires assistance from known gravitational forces. Even with correct orientation and known gravitational forces, causing the assembly to be deflected or directed toward the proper bore can be challenging. Furthermore, in significantly deviated wells, gravitational forces may not be known or otherwise may not be usable in assembly deflection.

Accordingly, assemblies and devices are desirable that can facilitate delivery of an assembly to the correct and intended bore without requiring use of gravitational forces for assistance and not necessarily requiring correct orientation of the assembly.

SUMMARY

Certain aspects of the present invention are directed to a deflector assembly that includes two deflectors that can direct a bullnose assembly into an intended wellbore based on the distance between the two deflectors and a configuration of the bullnose assembly.

One aspect relates to a deflector assembly that includes a first deflector and a second deflector. The second deflector is spaced from the first deflector and can direct a bullnose assembly into one of a plurality of wellbores by cooperating with the first deflector based on a size of a bullnose of the bullnose assembly.

Another aspect relates to a deflector assembly that includes a first deflector and a second deflector. The first deflector includes an opening. The opening has a first channel and a second channel. The first channel has a diameter that is less than the second channel. The second deflector is spaced from the first deflector and can receive a bullnose assembly deflected by the first deflector prior to deflecting the bullnose assembly towards a main wellbore or a lateral wellbore. The second deflector includes a first deflector channel and a second deflector channel that has a diameter that is less than the first deflector channel.

Another aspect relates to a wellbore assembly that includes a first deflector and a second deflector. The second deflector includes a first channel and a second channel. The second deflector is spaced from the first deflector by an amount that is less than a longitudinal length of a bullnose of a bullnose assembly. The first deflector can support the bullnose subsequent to the first deflector diverting the bullnose and can prevent the bullnose from moving laterally within the deflector assembly toward the first channel.

These illustrative aspects and features are mentioned not to limit or define the invention, but to provide examples to aid understanding of the inventive concepts disclosed in this disclosure. Other aspects, advantages, and features of the present invention will become apparent after review of the entire disclosure.

DETAILED DESCRIPTION

Certain aspects and features relate to a deflector assembly that includes two deflectors that can cooperate for directing an assembly toward an intended bore in a multi-bore well based on a configuration of the assembly without requiring use of gravitational forces or requiring the assembly to be oriented in a certain manner.

In some aspects, the deflector assembly includes two deflectors that are spaced from each other by a certain distance. The deflector closer to the surface can support a bullnose of a bullnose assembly having a length that is greater than the distance such that the deflector closer to the surface can cause the bullnose to be received by a selected channel of the second deflector. By receiving the bullnose through the selected channel, the second deflector can guide the bullnose toward the intended bore. The deflector closer to the surface can allow a bullnose having a length that is less than the distance to move in such a manner as to allow that bullnose to be received by a different channel of the second deflector having a large enough diameter to receive the bullnose and through which the second deflector can guide the bullnose toward a different, intended bore.

In some aspects, the two deflectors are separate devices of the assembly. In other aspects, the two deflectors are formed by one integral piece.

A well according to some aspects may contain multiple junctions at each of which is a deflector assembly that includes two or more deflectors. The deflectors in each deflector assembly can deflect a bullnose assembly to a selected bore of more than one bore according to the configuration of the bullnose of the bullnose assembly. A well according to other aspects includes a dual completion including multiple bores, but no junctions. A deflector assembly can be used to guide a bullnose assembly or other component to the proper bore.

These illustrative aspects and examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present invention.

Figure 1:
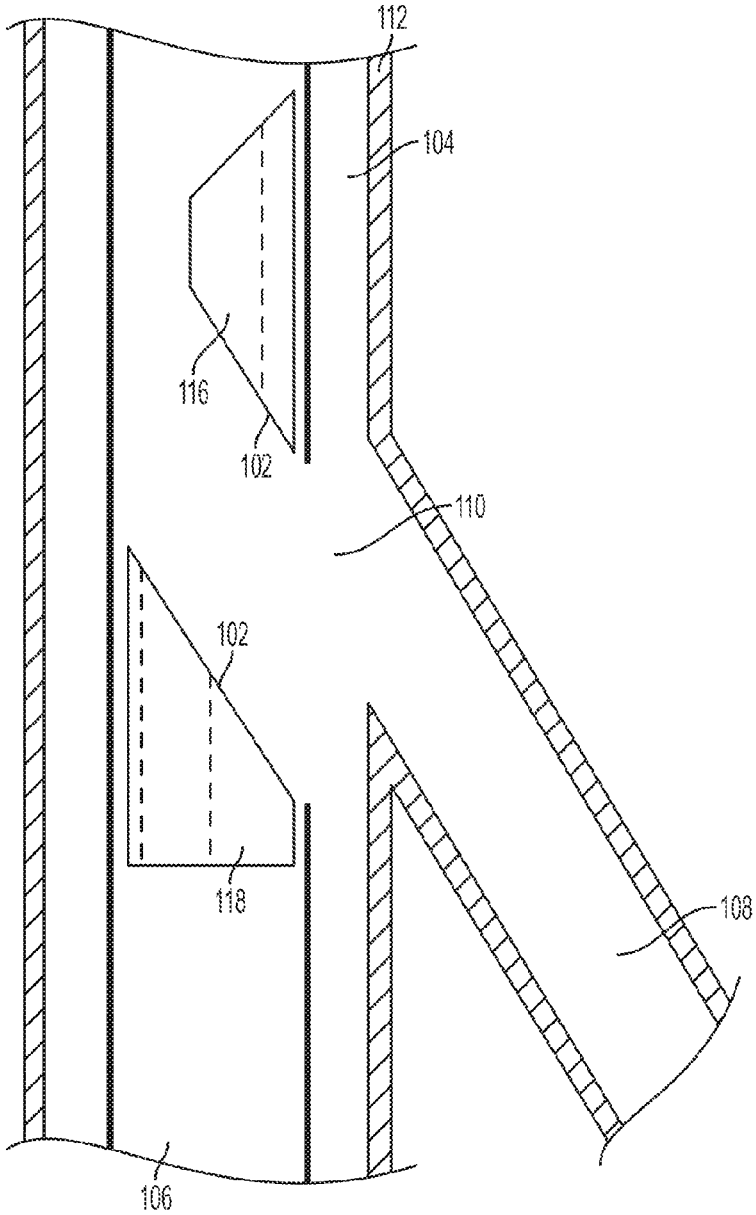
FIG. 1 is a schematic illustration of a well system having a deflector assembly according to one aspect of the present invention.

FIG. 1 depicts a well system with a deflector assembly 102 according to certain aspects of the present invention. The well system includes an initial bore 104 and two additional bores 106 and 108 extending from the initial bore 104 at a junction 110. The initial bore 104 and the additional bores 106 and 108 include a casing string 112 that can be cemented in the well. A tubing string can extend within the well system.

Included in the tubing string at or close to the junction 110 is the deflector assembly 102. The deflector assembly 102 includes two deflectors 116 and 118. Deflector 116 is closer to the surface (not shown) than deflector 118. The deflectors 116 and 118 can cooperate based on a configuration of a bullnose assembly subsequently ran downhole to deflect the bullnose assembly to a selected one of the additional bores 106 and 108.

FIG. 1 depicts the deflector assembly 102 positioned in a substantially vertical section of the well, in part because deflector assemblies according to some aspects do not require gravitational forces to select a proper bore to which to deflect a bullnose assembly. Deflector assemblies according to other aspects can be positioned in substantially horizontal sections of wells. In a horizontal application in which a deflector assembly is oriented correctly, gravity may assist in guiding a bullnose assembly into a lower bore.

Furthermore, deflector assemblies according to some aspects can be used with well system features other than junctions, such as multistring completions and multi-bore completions.

Figure 2A:
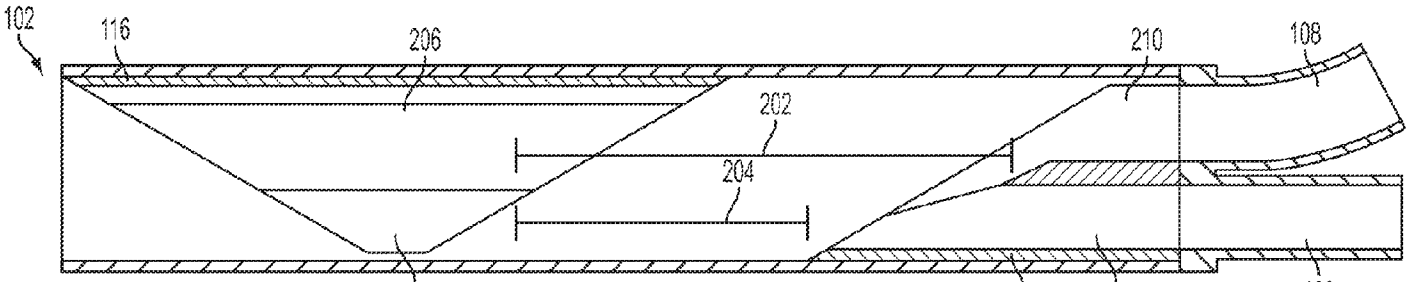
FIG. 2A is a cross-sectional side view of part of the well system in FIG. 1 including the deflector assembly according to one aspect of the present invention.
Figure 2B:
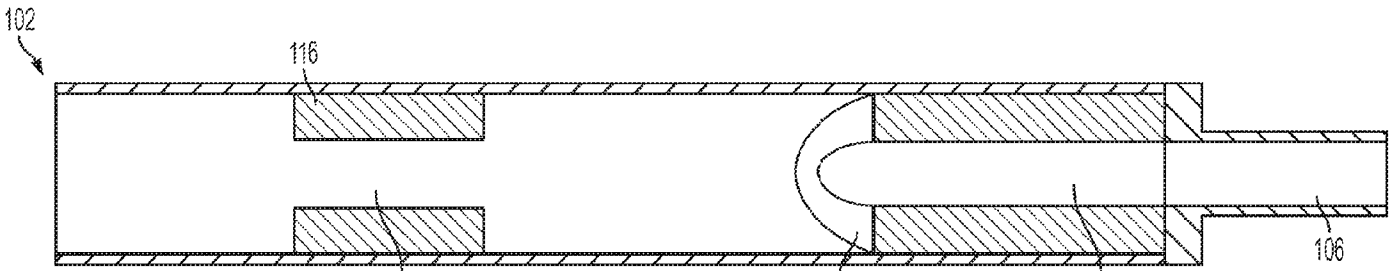
FIG. 2B is a cross-sectional bottom view of part of the well system in FIG. 1 including the deflector assembly according to one aspect of the present invention.
Figure 2C:
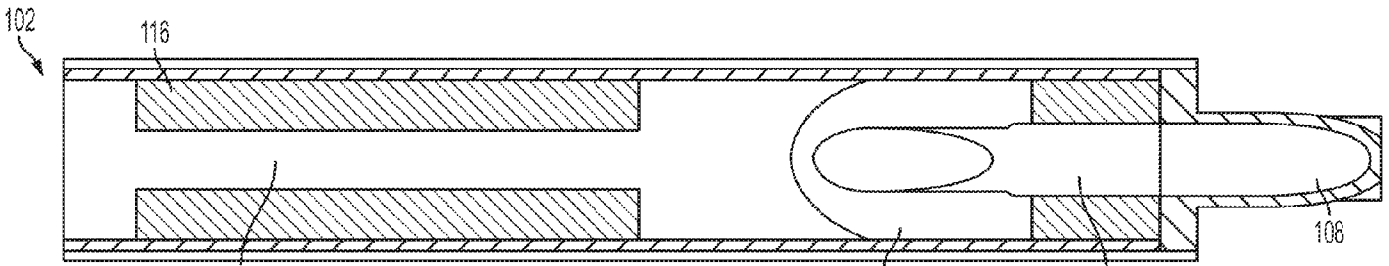
FIG. 2C is a cross-sectional top view of part of the well system in FIG. 1 including the deflector assembly according to one aspect of the present invention.

FIGS. 2A-C depict by longitudinal cross-sections the deflector assembly 102 according to one aspect. The deflector assembly 102 includes deflector 116 and deflector 118. Deflector 118 is spaced from deflector 116, as shown in FIG. 2A, by a first distance 202 measured from a cross-sectional center of the second deflector 118, and by a second distance 204 measured from an end of the second deflector 118. A non-limiting example of the first distance 202 is four inches or longer, such as twenty-six inches. A non-limiting example of the second distance 204 is two or more inches, such as fifteen and one-half inches.

The first deflector 116 includes two channels 206 and 208. The second deflector 118 also includes two channels 210 and 212. The two channels 210 and 212 are separated from each other and can direct assemblies such as bullnose assemblies to additional bores 106 and 108. In other aspects, a second deflector includes two channels that are not separated. Instead, the second deflector includes an opening between the two channels that is sized to prevent a bullnose assembly to move between the two channels.

FIG. 2B is a cross-section of the deflector assembly depicting channel 208 of the first deflector 116 and channel 212 of the second deflector 118. FIG. 2C is a cross-section of the deflector assembly depicting channel 206 of the first deflector 116 and channel 210 of the second deflector 118.

Figure 3:
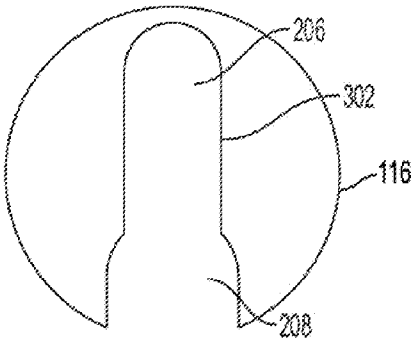
FIG. 3 is a lateral cross-sectional view of a first deflector of the deflector assembly according to one aspect of the present invention.

FIG. 3 is a lateral cross-section of the first deflector 116. Shown in FIG. 3 is an opening 302 that includes the channels 206 and 208. The opening 302 allows movement by a bullnose assembly between the channels 206 and 208. Channel 206 has a diameter that is less than the diameter of the channel 208. As a non-limiting example, the diameter of channel 206 may be three inches, while the diameter of channel 208 may be four inches.

Figure 4:
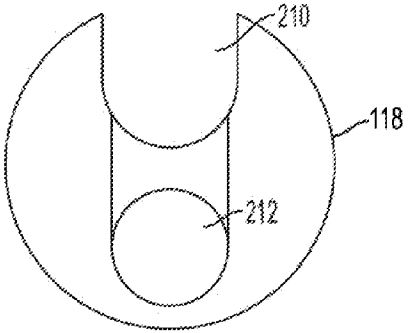
FIG. 4 is a lateral cross-sectional view of a second deflector of the deflector assembly according to one aspect of the present invention.

FIG. 4 is a lateral cross-section of the second deflector 118 depicting channels 210 and 212. Channel 212 has a diameter that is less than the diameter of channel 210. A non-limiting example of the diameter of channel 212 may be three and one-half inches and a non-limiting example of the diameter of channel 210 is four inches.

Although the channels 206, 208, 210 and 212 are shown and described as each having a diameter, channels according to other aspects may not have diameters and instead include cross-sectional lengths having relative sizes with each other described above in connection with diameters in FIGS. 3-4.

Figure 5:
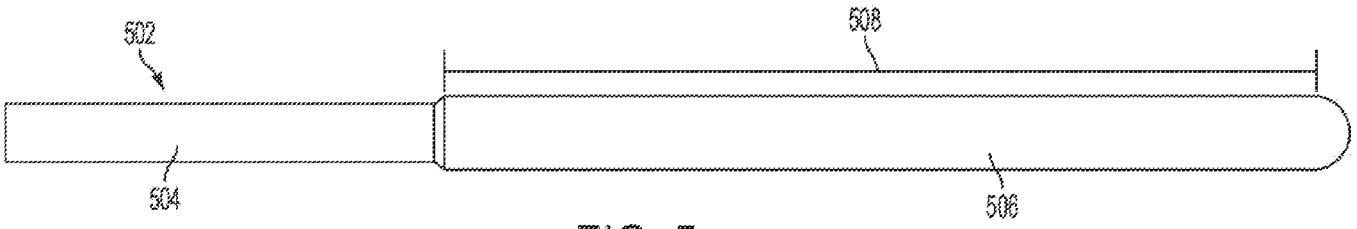
FIG. 5 is a side view of a first configuration of a bullnose assembly according to one aspect of the present invention.
Figure 6:
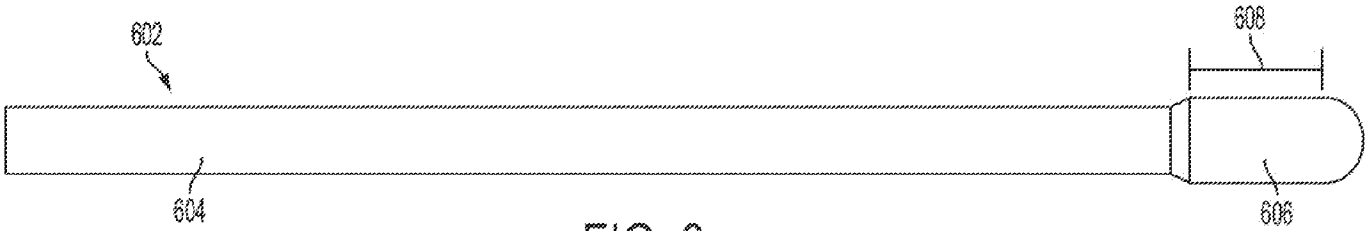
FIG. 6 is a side view of a second configuration of a bullnose assembly according to one aspect of the present invention.

Deflector assemblies according to various embodiments can deflect other assemblies ran downhole to a selected bore, depending on a configuration of the other assemblies. FIGS. 5-6 depict examples of these types of assemblies as bullnose assemblies.

FIG. 5 depicts by side view a bullnose assembly 502 that includes a body 504 and a bullnose 506 extending from the body 504. A "bullnose" may be a rounded off portion of an end of an assembly that can assist in allowing the assembly to be guided downhole. The bullnose 506 has a longitudinal length 508, measured from an end of the bullnose 506 that is coupled to the body 504 to a position at or close to a guiding end of the bullnose 506. The body 504 has a smaller width than the width of bullnose 506. In other aspects, the body 504 does not have a smaller width than the width of the bullnose 506. Regardless, the body 504 can be sized such that the body 504 can be received by channel 212.

FIG. 6 depicts by side view a bullnose assembly 602 that includes a body 604 and a bullnose 606 extending from the body 604. The bullnose 606 has a longitudinal length 608 that is less than the longitudinal length 508 of the bullnose assembly 502 in FIG. 5. The body 604 has a smaller width than the width of the bullnose 606.

The remaining figures depict examples of deflector assembly 102 deflecting the bullnose assemblies shown in FIGS. 5-6.

Figure 7:
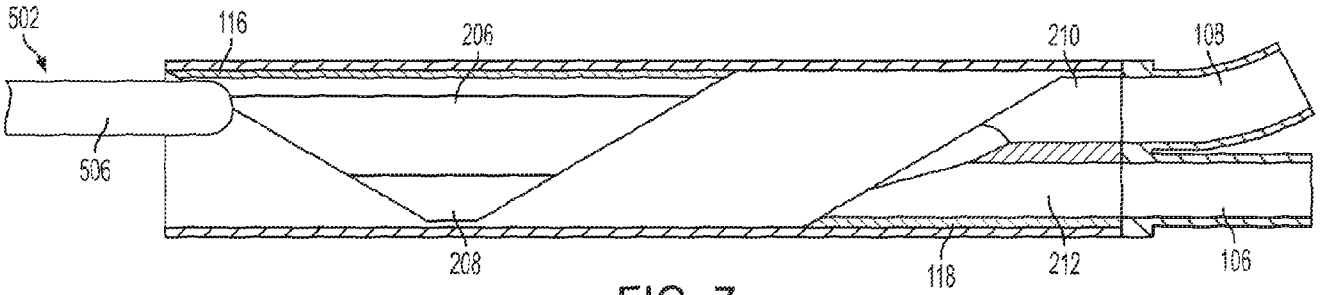
FIG. 7 is a cross-sectional side view of the deflector assembly in which the first configuration of the bullnose assembly is received according to one aspect of the present invention.
Figure 8:
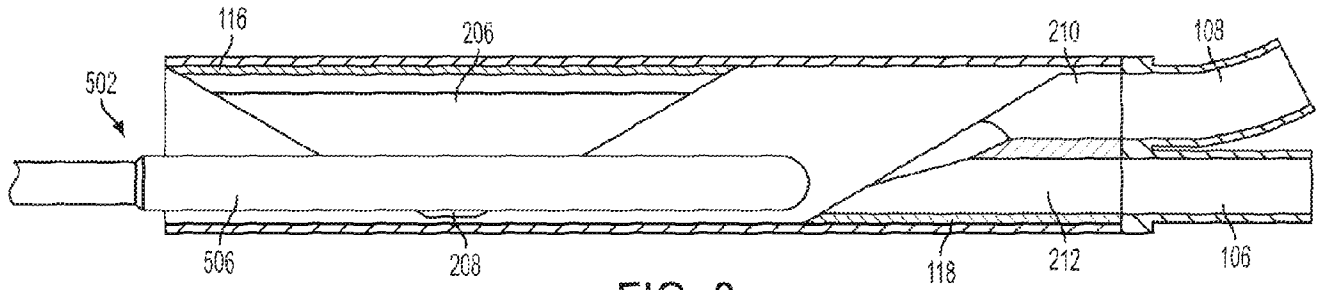
FIG. 8 is a cross-sectional side view of the defector assembly in which the first configuration of the bullnose assembly is located through a channel of the first deflector according to one aspect of the present invention.
Figure 9:
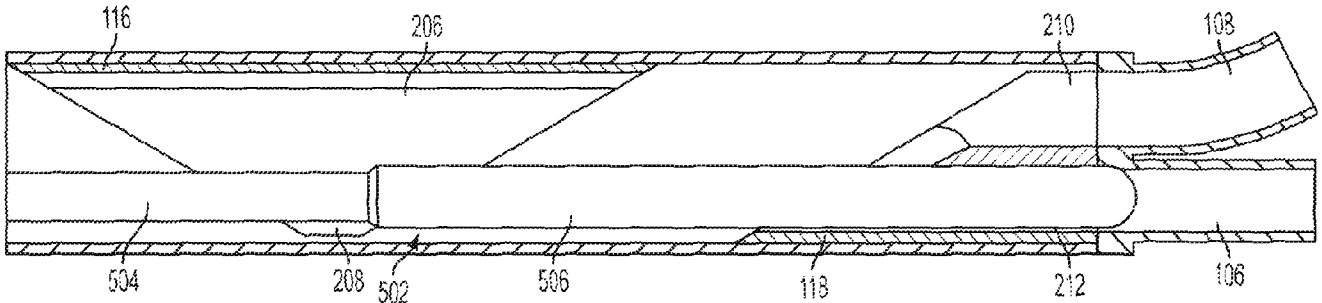
FIG. 9 is a cross-sectional side view of the deflector assembly in which the first configuration of the bullnose assembly is received by a channel of the second deflector and is supported by the first deflector according to one aspect of the present invention.

FIGS. 7-9 show the deflector assembly 102 deflecting bullnose assembly 502. In FIG. 7, the bullnose assembly 502 is depicted as contacting a surface of the first deflector 116. The width of the bullnose 506 is greater than the diameter of the channel 206 such that the bullnose assembly 502 is guided to channel 208, which has a diameter that is greater than the width of the bullnose 506. The bullnose 506 is received through channel 208, as shown in FIG. 8, as the width of bullnose 506 is less than the diameter of channel 208.

The bullnose assembly 502 is allowed to travel toward the second deflector 118 and is guided to channel 212 of the second deflector 118 by the first deflector 116. For example, because the diameter of channel 206 of the first deflector 116 is less than the width of the bullnose 506 and because the distance 202 is less than the longitudinal length of the bullnose 506, the bullnose 506 is prevented from moving laterally and toward the channel 210 of the second deflector 118 and is instead received by the channel 212 while part of the bullnose 506 is in the channel 208 of the first deflector 116, as shown in FIG. 9. The channel 212 has a diameter that is greater than the width of the bullnose 506 and can guide the bullnose 506 toward bore 106, which can be the bore to which the bullnose assembly 502 is intended to enter.

Figure 10:
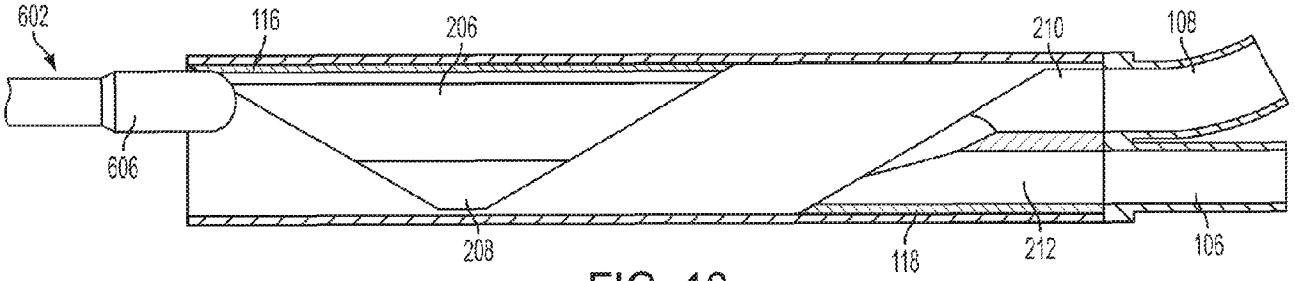
FIG. 10 is a cross-sectional side view of the deflector assembly in which the second configuration of the bullnose assembly is received according to one aspect of the present invention.
Figure 11:
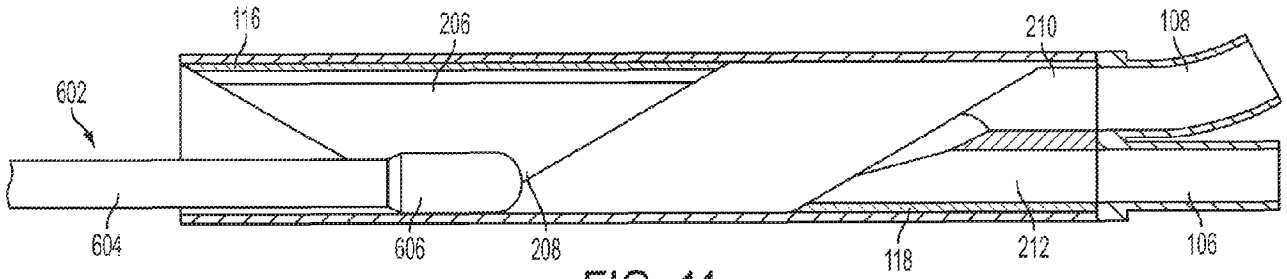
FIG. 11 is a cross-sectional side view of the deflector assembly in which a bullnose of the second configuration of the bullnose assembly is in a channel of the first deflector according to one aspect of the present invention.

FIGS. 10-15 show the deflector assembly 102 deflecting bullnose assembly 602. FIG. 10 depicts the bullnose assembly 602 contacting a deflector surface of the deflector assembly 102. Because the width of the bullnose 606 is greater than channel 206, the deflector assembly 102 guides the bullnose 606 toward the channel 208 through which the bullnose 606 is received, as shown in FIG. 11.

Figure 12:
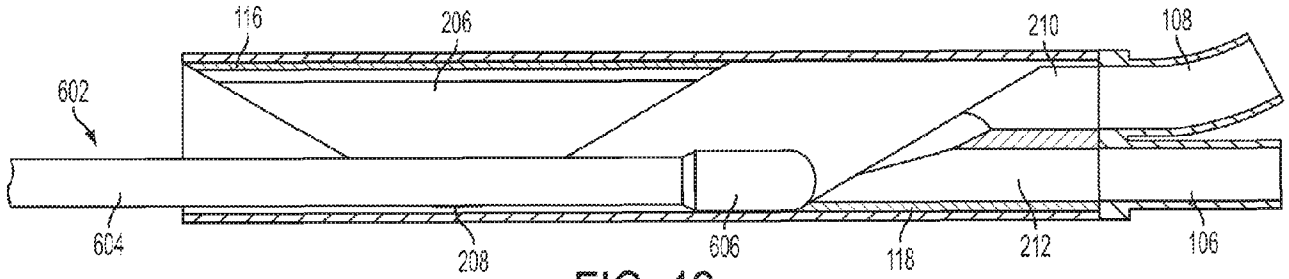
FIG. 12 is a cross-sectional side view of the deflector assembly in which a body of the second configuration of the bullnose assembly is in the channel of the first deflector and the bullnose is between the first deflector and the second deflector according to one aspect of the present invention.
Figure 13:
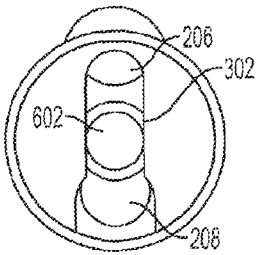
FIG. 13 is a lateral cross-sectional view the deflector assembly in which the second configuration of the bullnose assembly is allowed to move laterally according to one aspect of the present invention.
Figure 14A:
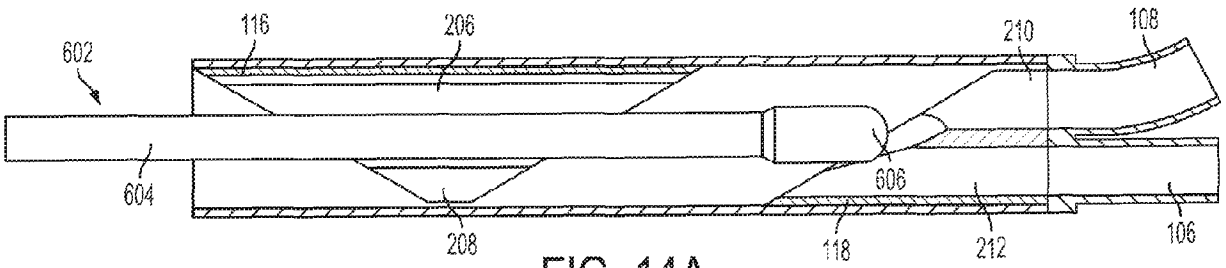
FIG. 14A is a cross-sectional side view of the deflector assembly in which the second configuration of the bullnose assembly is allowed to move laterally according to one aspect of the present invention.
Figure 14B:
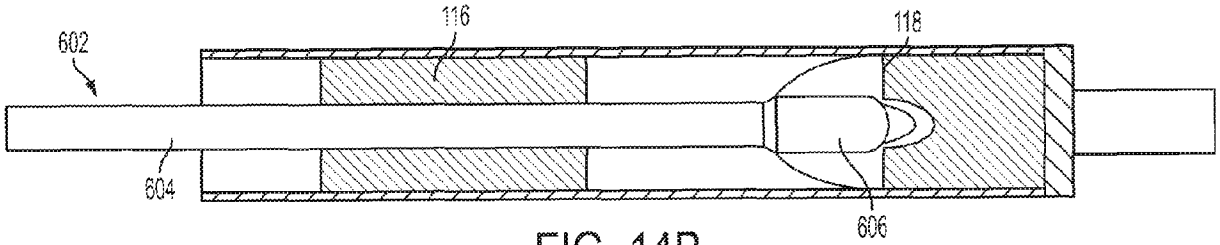
FIG. 14B is a cross-sectional top view of the deflector assembly in which the second configuration of the bullnose assembly is allowed to move laterally according to one aspect of the present invention.

The bullnose 606 can travel through the channel 208 toward the second deflector 118. Because the longitudinal length of the bullnose 606 is less than the distance 204, the bullnose 606 is not supported by or in the first deflector 116 when the bullnose 606 contacts the second deflector 118, as shown in FIG. 12. Because the diameter of channel 212 in the second deflector 118 is less than the width of the bullnose 606, the second deflector 118 guides the bullnose assembly 602 toward channel 210. The diameter of the channel 206 is less than the width of the body 604 and can allow the body 604 to move laterally within the first deflector 116 from channel 208 to channel 206, as shown in FIG. 13, which is a view of an end of the deflector assembly 102. FIG. 14A is a cross-sectional side view and FIG. 14B is a cross-sectional top view of the deflector assembly 102 in which the body 604 of the bullnose assembly 602 is allowed to move from channel 208 to channel 206 as the bullnose 606 is guided toward channel 210 of the second deflector 118.

Figure 15:
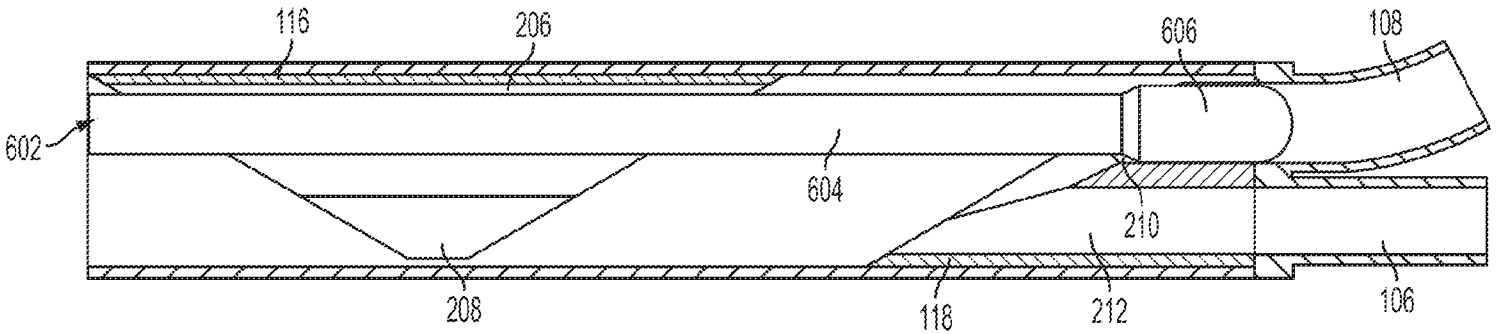
FIG. 15 is a cross-sectional side view of the deflector assembly in which the bullnose is in a second channel of the second deflector and the body is in a second channel of the first deflector according to one aspect of the present invention.

The bullnose 606 can be received by the channel 210 and guided toward bore 108—the intended bore for bullnose assembly 602—as shown in FIG. 15, because the diameter of channel 210 is greater than the width of bullnose 606.

The foregoing description of the aspects, including illustrated aspects, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention. For example, deflector assemblies according to various aspects can deflect assemblies other than bullnose assemblies that have suitable geometric configuration for desired deflection performance.

What is claimed is:

1. A deflector assembly, comprising:

a first deflector comprising an opening having a first channel and a second channel, wherein the first channel has a diameter that is less than the second channel; and a second deflector spaced from the first deflector and configured for directing a bullnose assembly into one of a plurality of wellbores by cooperating with the first deflector based on a size of a bullnose of the bullnose assembly, wherein the second deflector comprises a first deflector channel and a second deflector channel having a diameter that is less than the first deflector channel, wherein the second deflector is configured for directing the bullnose assembly into one of the plurality of wellbores subsequent to receiving the bullnose assembly deflected by the first deflector.

2. The deflector assembly of claim 1, wherein the second deflector is spaced from the first deflector by a distance that is less than a longitudinal length of the bullnose.

3. The deflector assembly of claim 2, wherein the first deflector is configured for supporting the bullnose assembly by preventing the bullnose assembly from moving laterally when the bullnose is received by the second deflector.

4. The deflector assembly of claim 2, wherein the distance is more than the longitudinal length of a second bullnose of a second bullnose assembly, wherein the first deflector is configured to allow the second bullnose assembly to move laterally within the deflector assembly subsequent to the second bullnose being deflected by the second deflector.

5. A deflector assembly, comprising:

a first deflector comprising an opening having a first channel and a second channel, the first channel having a diameter that is less than the second channel; and a second deflector spaced from the first deflector for receiving a bullnose assembly deflected by the first deflector prior to deflecting the bullnose assembly towards one of at least two wellbores, the second deflector comprising a first deflector channel and a second deflector channel having a diameter that is less than the first deflector channel.

6. The deflector assembly of claim 5, wherein the second deflector is spaced from the first deflector by a distance that is less than a longitudinal length of a bullnose of the bullnose assembly configured for being received by the second deflector channel.

7. The deflector assembly of claim 6, wherein the distance is more than the longitudinal length of a second bullnose of a second bullnose assembly configured for being received by the first deflector channel and prevented from being received by the second deflector channel.

8. The deflector assembly of claim 7, wherein the first deflector is configured to allow a body of the second bullnose assembly to move between the first channel and the second channel subsequent to the second bullnose being deflected by the second deflector.

9. The deflector assembly of claim 8, wherein the diameter of the body of the second bullnose is less than the diameter of the first channel.

10. The deflector assembly of claim 7, wherein the diameter of the first channel and the diameter of the second deflector channel are less than the diameter of the second bullnose.

11. The deflector assembly of claim 10, wherein the diameter of the second bullnose is less than the diameter of the first deflector channel.

12. The deflector assembly of claim 6, wherein the first deflector is configured for supporting the bullnose when the bullnose is received by the second deflector channel and for preventing the bullnose from being received by the first deflector channel.

13. The deflector assembly of claim 5, wherein the bullnose assembly comprises a bullnose and a body coupled to the bullnose, wherein the diameter of the body is less than the diameter of the second deflector channel.

14. The deflector assembly of claim 5, wherein the diameter of the first channel is less than the diameter of a bullnose of the bullnose assembly, wherein the diameter of the bullnose is less than the diameter of the second deflector channel.

15. A wellbore assembly, comprising:

a bullnose assembly comprising a bullnose;

a first deflector; and a second deflector comprising a first channel and a second channel, the second deflector being spaced from the first deflector by an amount that is less than a longitudinal length of the bullnose of the bullnose assembly, the first deflector being configured for supporting the bullnose subsequent to the first deflector diverting the bullnose and for preventing the bullnose from moving laterally within the wellbore assembly toward the first channel.

16. The wellbore assembly of claim 15, wherein the first deflector comprises an opening having a first deflector channel and a second deflector channel, the first deflector channel having a diameter that is less than the second deflector channel, wherein a bullnose assembly body is allowed to move laterally between the first deflector channel and the second deflector channel.

17. The wellbore assembly of claim 16, wherein the diameter of the first deflector channel is less than a width of the bullnose.

18. The wellbore assembly of claim 15, wherein the amount is more than the longitudinal length of a second bullnose of a second bullnose assembly configured for being received by the first channel and prevented from being received by the second channel by the second channel being smaller than a width of the second bullnose.

19. The wellbore assembly of claim 15, wherein the second deflector is configured for diverting the bullnose assembly into one of a plurality of wellbores that is selected based on the longitudinal length of the bullnose being longer than the amount by which the second deflector is spaced from the first deflector.

* * * * *